US005975370A

United States Patent [19]

Durliat

[11] Patent Number: 5,975,370

[45] Date of Patent: Nov. 2, 1999

[54] TAMPER-EVIDENT PLUNGER-HOLD-DOWN ATTACHMENT FOR PUMP DISPENSER

[75] Inventor: Leonora M. Durliat, Toledo, Ohio

[73] Assignee: Owens-Illinois Closure Inc., Toledo, Ohio

[21] Appl. No.: 09/039,221

[22] Filed: Mar. 16, 1998

[51] Int. Cl.[6] ..... B67D 5/32

[52] U.S. Cl. ..... 222/153.06; 222/153.13; 222/384

[58] Field of Search ..... 222/153.13, 384, 222/321.7, 321.9

[56] References Cited

U.S. PATENT DOCUMENTS 39,618 8/1863 Phillips .
1,653,865 12/1927 Mac Gregor .
4,353,483 10/1982 Pehr .
4,368,830 1/1983 Soughers .
4,377,106 3/1983 Workman et al. .
4,384,660 5/1983 Palmisano et al. .
4,424,919 1/1984 Knox et al. .
4,511,064 4/1985 Ruscitti et al. ..... 222/153.06
5,207,359 5/1993 Steijns .
5,662,246 9/1997 Contaxis, III .

*Primary Examiner*—Philippe Derakshani

[57] ABSTRACT

The attachment comprises a cylinder-embracing support portion at least partly encircling the upper end of the pump cylinder and having openings therein receiving hooks on the cylinder. Unitary with the support portion is a plunger hold-down portion which engages the upper end of the actuator portion of the plunger. The attachment has a tamper-evident frangible zone located between the cylinder-embracing support portion and the engagement with the actuator portion.

16 Claims, 5 Drawing Sheets

TAMPER-EVIDENT PLUNGER-HOLD-DOWN ATTACHMENT FOR PUMP DISPENSER

FIELD OF THE INVENTION

This invention relates to a tamper-evident attachment for holding down the plunger of a pump dispenser rendering the dispenser inoperative. More specifically, this invention relates to such an attachment having a support portion which may be installed over the upper end of the cylinder of the pump and which has an integral hold-down portion adapted to engage the actuator portion of the plunger and hold it down. The attachment has a frangible zone whereby part may be stripped off to free the plunger.

BACKGROUND OF THE INVENTION

In the prior art, a common liquid dispenser has been in the form of a reciprocable pump in which the plunger means has had an actuator portion at its upper end, the actuator portion being formed with a dispensing spout. By virtue of such structure, the plunger means may be depressed with one hand while the other hand receives the liquid. A spring returns the plunger. The pumping and receiving can be accomplished with one hand. Examples of such a pump dispenser are disclosed in the U.S. Pat. No. 3,064,310 which issued to R. C. Cooprider Nov. 20, 1962 and U.S. Pat. No. 3,180,534 which issued to O. H. Duda et al Apr. 27, 1965.

In order to assure the consumer that the contents of such dispensers are pristine at purchase and have not been partly used, contaminated or otherwise tampered with, tamper-evident covers or guards have been provided. In one version the guard has been in the form of an attachment to the top of such a dispenser. U.S. Pat. No. 4,424,919 which issued Jan. 10, 1984, to Knox et al discloses a dispenser having an attachment which hooks under an inward lip of a rotatable extension to the usual screw cap and bridges over the top of the actuator to hold it down. Tear lines are formed in the attachment so that a portion of the attachment can be torn away. The look of the torn attachment, still on the container, or if it is missing altogether, makes the tampering evident to the subsequent shopper.

The requirement of a special rotatable extension of Knox et al has, of course, meant an additional part which has had to be assembled onto the cap. In addition, it has sometimes been tricky to hook the clip under the ledge in a reliable manner.

SUMMARY OF THE INVENTION

The present invention has for an object the provision of an effective tamper-evident attachment to a commercially available pump dispenser which does not require any modification of the dispenser.

It is a further object of the invention to provide an attachment which is readily fitted on to the pump.

The invention is, of course, set forth in the claims following this specification. In summary, it may be described as a fluid dispensing pump having a rotatable container cap for mounting the pump on the finish of a container of fluid to be dispensed, the pump comprising a cylinder extending through the cap and having spaced upstanding outward hooks at the upper end thereof. A reciprocable hollow plunger means projects into the cylinder and has an actuator portion/discharge outlet through which fluid is expelled upon depressing the plunger means.

In this structure the invention is a tamper-evident attachment comprising a cylinder-embracing support portion at least partly encircling the cylinder and having openings therein receiving the hooks respectively, and a plunger means hold-down portion unitary with the cylinder-embracing support portion and extending upward therefrom and engaging the actuator portion and holding the plunger means down, the attachment having a tamper-evident frangible zone located between the cylinder-embracing support portion and the engagement of the hold-down portion with the actuator portion of the plunger means.

BRIEF DESCRIPTION OF THE DRAWINGS

Further objects and features of the invention will be clear to those skilled in the art from a review of the following specification and drawings, all of which present a non-limiting form of the invention. In the drawings.

DESCRIPTION OF THE PREFERRED EMBODIMENT

Figure 1:
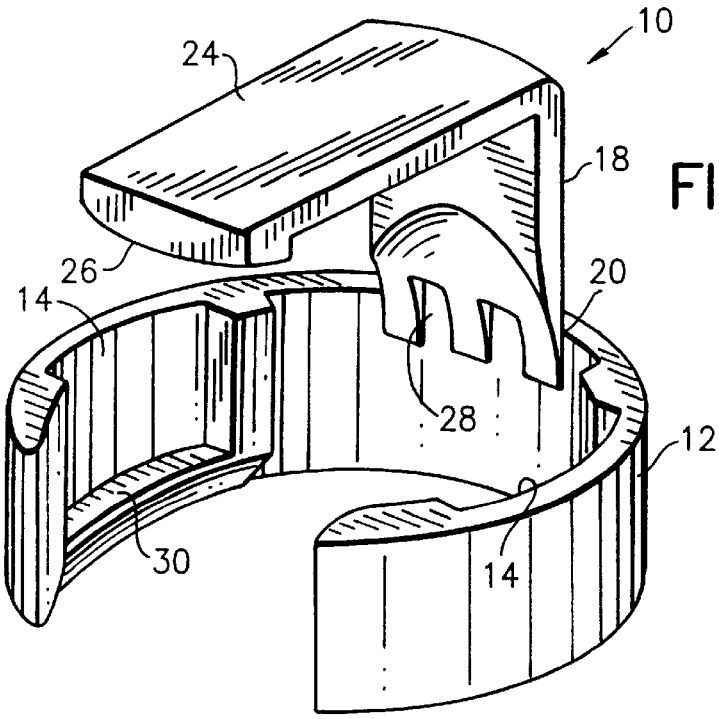
FIG. 1 is a perspective view of a plunger means hold-down attachment embodying the invention.

FIG. 1 shows a tamper-evident attachment embodying the invention and generally designated 10. It comprises a cylinder-embracing support portion 12 having inwardly facing openings 14 therein.

Figure 4:
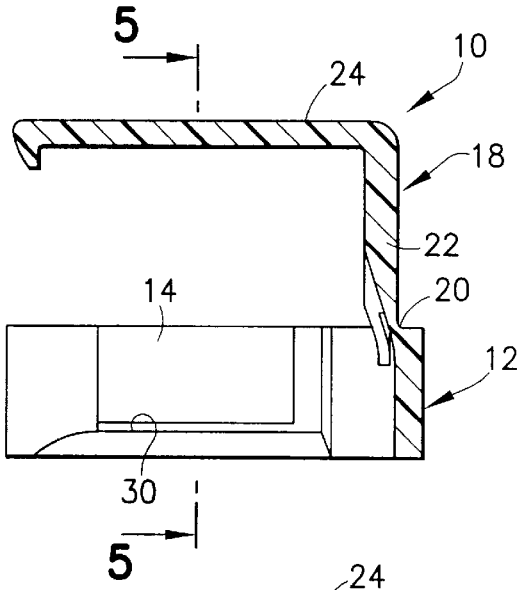
FIG. 4 is a sectional view taken on the line 4—4 of FIG. 3.
Figure 5:
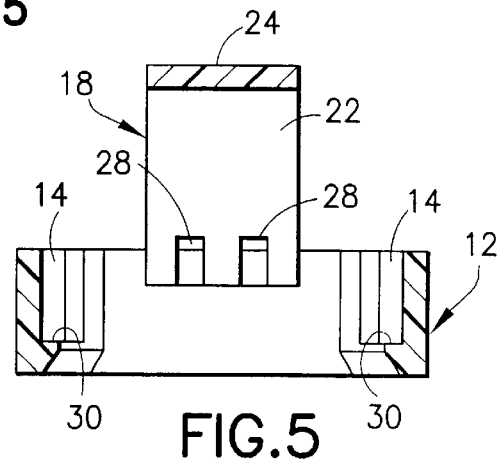
FIG. 5 is a sectional view taken on the line 5—5 of FIG. 4.

A plunger means hold-down portion 18 extends upwardly from the cylinder-embracing support portion 12. As shown, the hold-down portion 18 is unitary with the support portion 12 and meets the inner periphery thereof (FIG. 4) at a juncture 20. The hold-down portion comprises a vertical run 22 from the upper end of which extends a horizontal run 24 extending over the center of the C-shaped support portion 12 and terminating in a downward rib 26.

Preferably, the attachment is a unitary molded piece, molded from polypropylene or high-density polyethylene.

At the juncture 20 the hold-down portion 18 is thinned (FIG. 4) and tapered to flow into the inside surface of the support portion 12. Perforations 28 at the juncture constitute a frangible zone of the attachment.

The openings 14 are formed at their lower ends with inward ledges 30.

Figure 2:
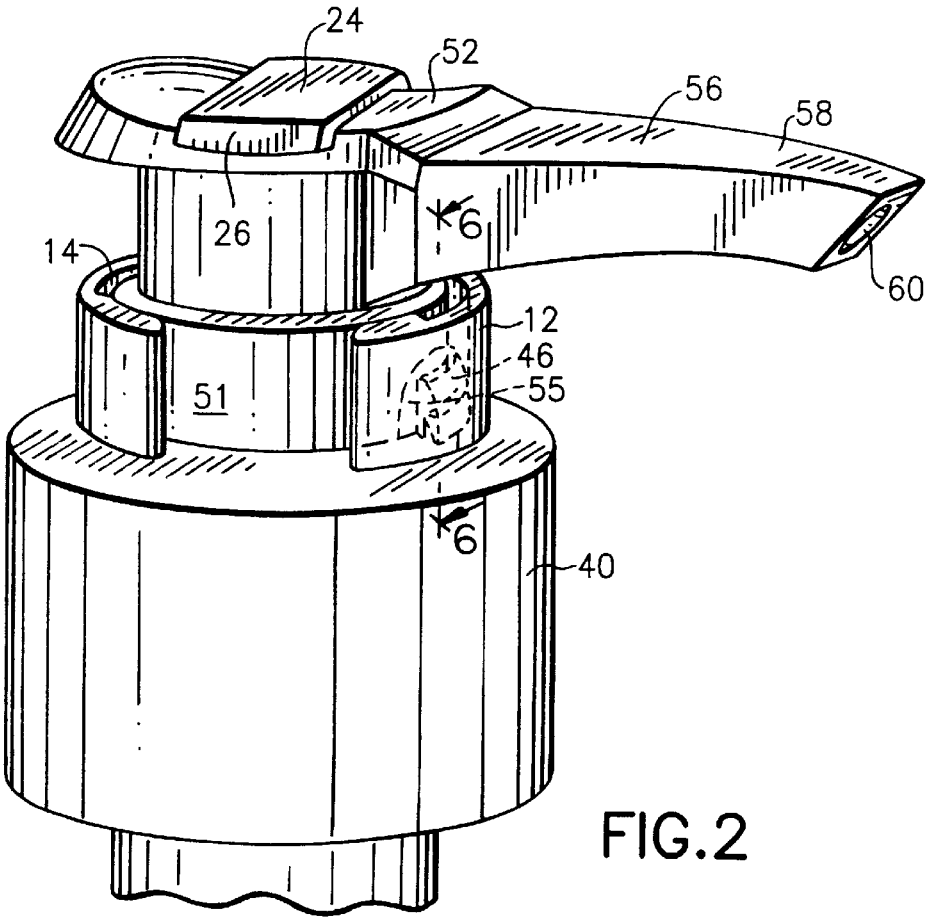
FIG. 2 is a perspective view, slightly reduced, showing the attachment installed on a pump dispenser, holding down the plunger means.
Figure 3:
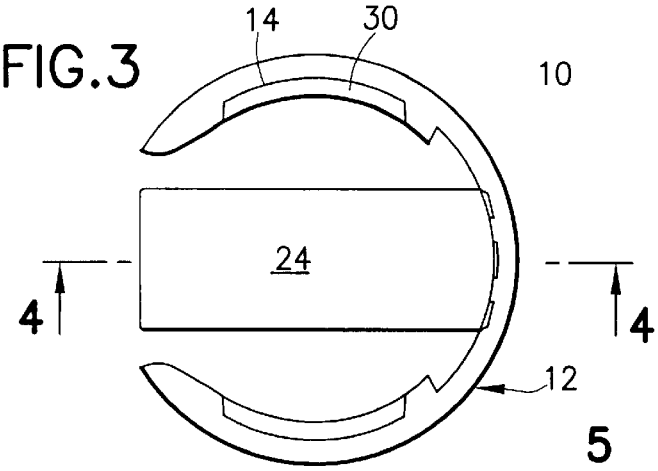
FIG. 3 is a top plan view of an attachment embodying the invention.
Figure 6:
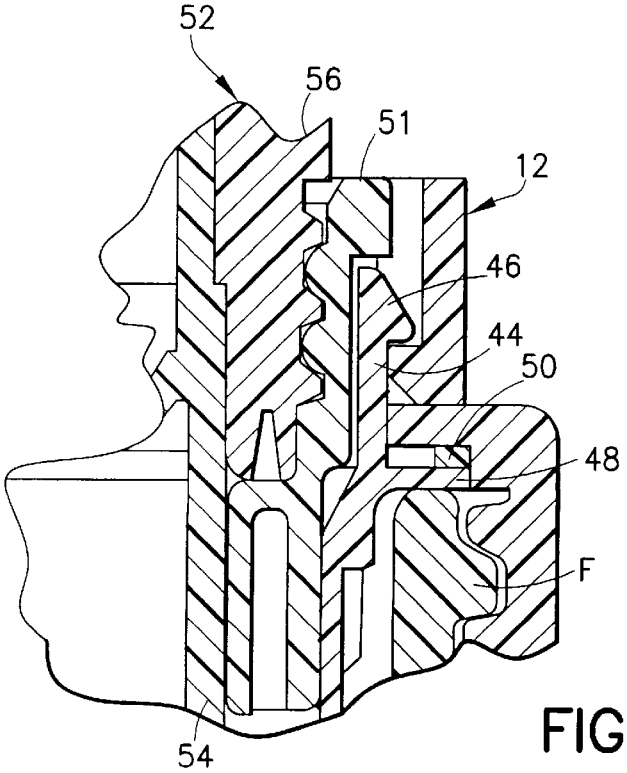
FIG. 6 is a greatly enlarged sectional view taken on the line 6—6 of FIG. 2.

FIG. 2 shows the attachment of FIG. 1 installed on the upper end of a pump dispenser. The dispenser comprises a cap 40 which can be screwed onto the finish F of a container (FIG. 6). The cap 40 has a central opening through which extends the pump cylinder 42. The upper end of the cylinder 42 (FIG. 6) is formed with narrow upward tabs 44 on which are disposed outward hooks 46. The hooks 46 are spaced above the top wall of the cap 40. The cylinder 42 is also formed with an outward flange 48, and a resilient seal 50 is disposed between the flange 48 and the top wall of the cap 40 to assure a seal when the pump is installed on the finish F of the container.

Secured into the upper end of the cylinder is the collar 51 which is internally threaded.

Plunger means 52 extends through the collar 51 and is reciprocably disposed in the cylinder as is well known in the art. It comprises the lower piston portion 54 co-operating with the wall of the cylinder 42 to pump, and an upper actuator portion 56 into which the piston portion is telescoped. As shown in FIG. 2, the actuator portion 56 may comprise a lateral spout 58 through which runs a discharge outlet 60. The plunger means 52 is threaded as shown and may be screwed into the collar 51, as shown, to hold it down once the dispenser has been opened by the consumer. A spring in the cylinder 42 (not shown) urges the plunger means 51 upward.

In assembly, the hold-down portion 18 is installed on the actuator portion 52, rib 26 hooking over the side of the actuator portion 56 as shown. The attachment may be pressed down over the tabs 44 comprising the upper end of the cylinder 42 so that the support portion 12 engages the hooks 46 and springs outward thereover to snap tight as the ledges 30 engage under the hooks 46. This holds the attachment down snugly against the cap 40 and holds the actuator portion 56 down with the plunger means 52 in retracted position. The pump can then be inserted in the container and cap 40 can then be screwed onto the finish F of the container.

In preparing the pump dispenser for use, the purchaser will forcibly hinge the hold-down portion 18 backward from the actuator portion 52, causing it to break at the frangible zone 28 away from the support portion 12. This permits the plunger means 52 to rise, driven up by the conventional internal spring (not shown). The support portion 12 stays with the cap 40. If the shopper should see that the hold-down portion 18 has been broken away from a "new" dispenser, it will be evident to him that the dispenser has been tampered with.

First Modification

Figure 7:
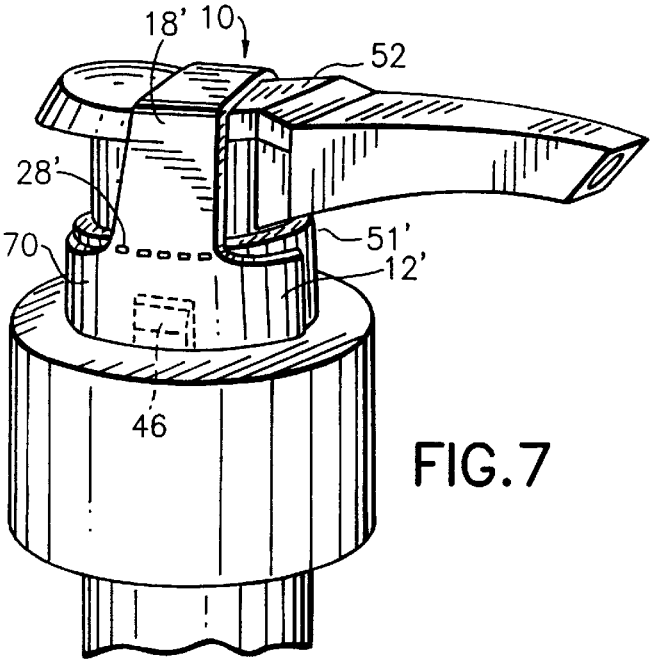
FIG. 7 is a perspective view of a modified form.
Figure 8:
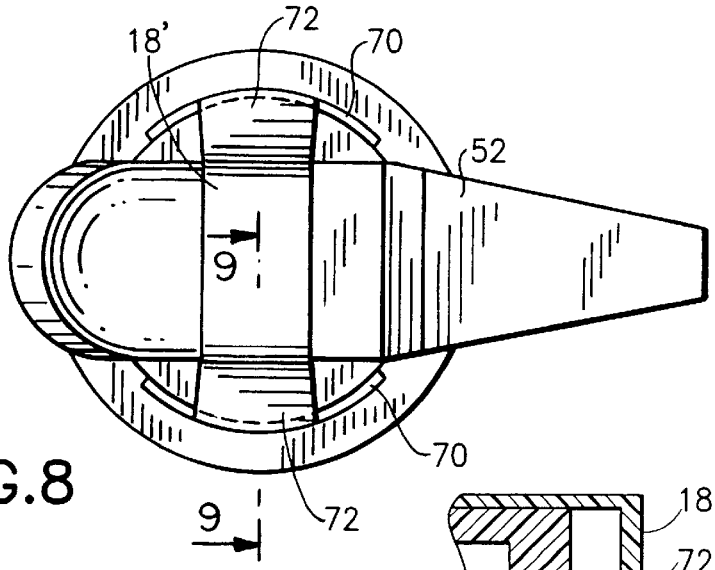
FIG. 8 is a top plan view of the embodiment shown in FIG. 7.
Figure 9:
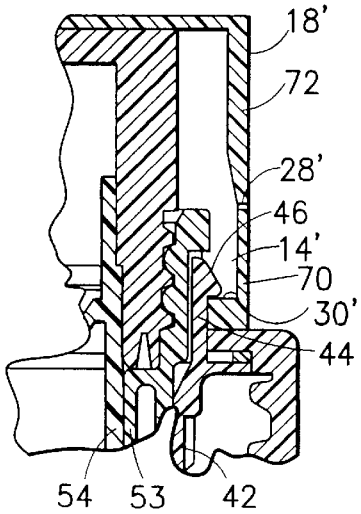
FIG. 9 is a fragmentary sectional view taken on the line 9—9 of FIG. 8.

FIGS. 7 through 9 show a modified form of the attachment 10'. In these figures, where applicable, the primed form of the same reference numeral is used to designate corresponding parts numbered in the FIGS. 1 through 6 embodiment.

The unitary molded attachment 10' comprises the support portion 12' which is a pair of arcuate pads 70 formed with openings 14 with underlying inward ledges 30'. The pads embrace the tabs 44 on the upper end of the cylinder from opposite sides and are held in position by the hooks 46 in the openings 14.

The hold-down portion 18' comprises an inverted U-shaped arch, the center of which bears down on the top of the actuator portion 52 having legs 72 which meet the pads 70 in a perforated frangible zone 28. The hold-down portion 18' is rigid enough to help hold the pads 70 against the tabs 44 at the upper end of the cylinder 42 and collar 51.

The assembly of this attachment 10' onto the pump dispenser is as described in connection with the FIGS. 1 through 6 embodiment. The hold-down attachment 10' may be broken away from the dispenser by tearing the legs 72 away from the support portion 12' at the frangible zone 28' of perforation.

Second Modification

Figure 10:
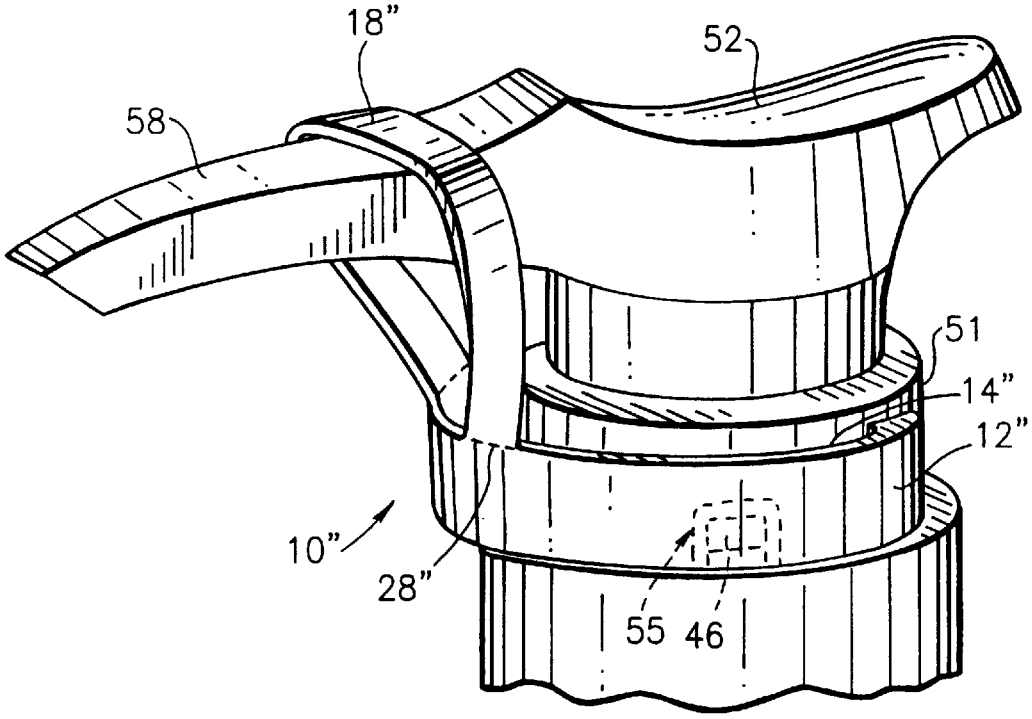
FIG. 10 is a perspective view showing a further modified form of attachment installed on a pump dispenser.
Figure 11:
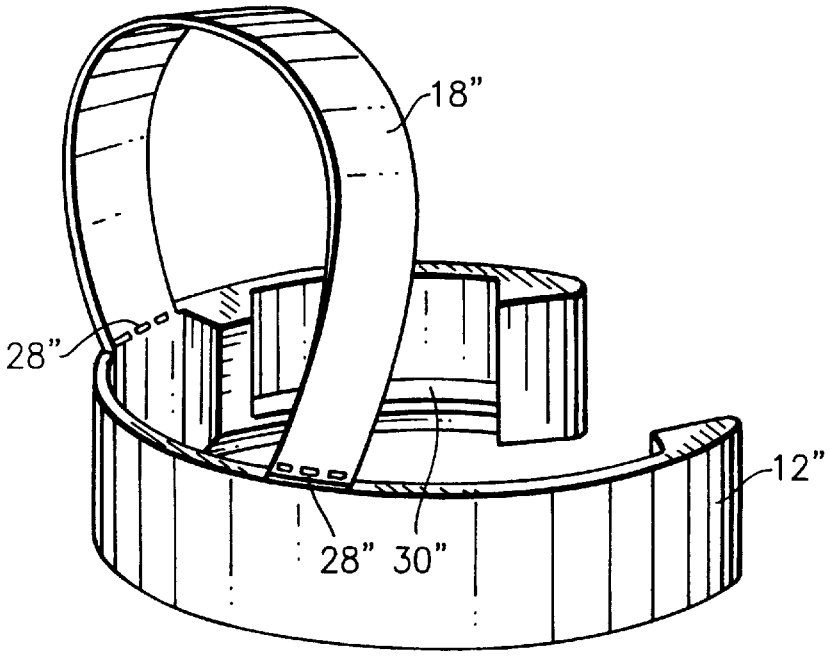
FIG. 11 is a perspective view of the attachment of FIG. 10.

Modification of FIGS. 10 and 11 comprise a attachment 10" in which the C-shaped support portion 12" is similar to that of the FIG. 1 embodiment. The hold-down portion 18" is in the form of a loop unitary with the support portion 12" and extending upward therefrom to pass over and bear down against the top of the spout 58. The lines of perforation 28" comprise a frangible zone enabling the user to break the hold-down portion 18" away from the support portion 12" and liberate the actuator portion 52 to permit the plunger means to rise.

Third Modification

Figure 12:
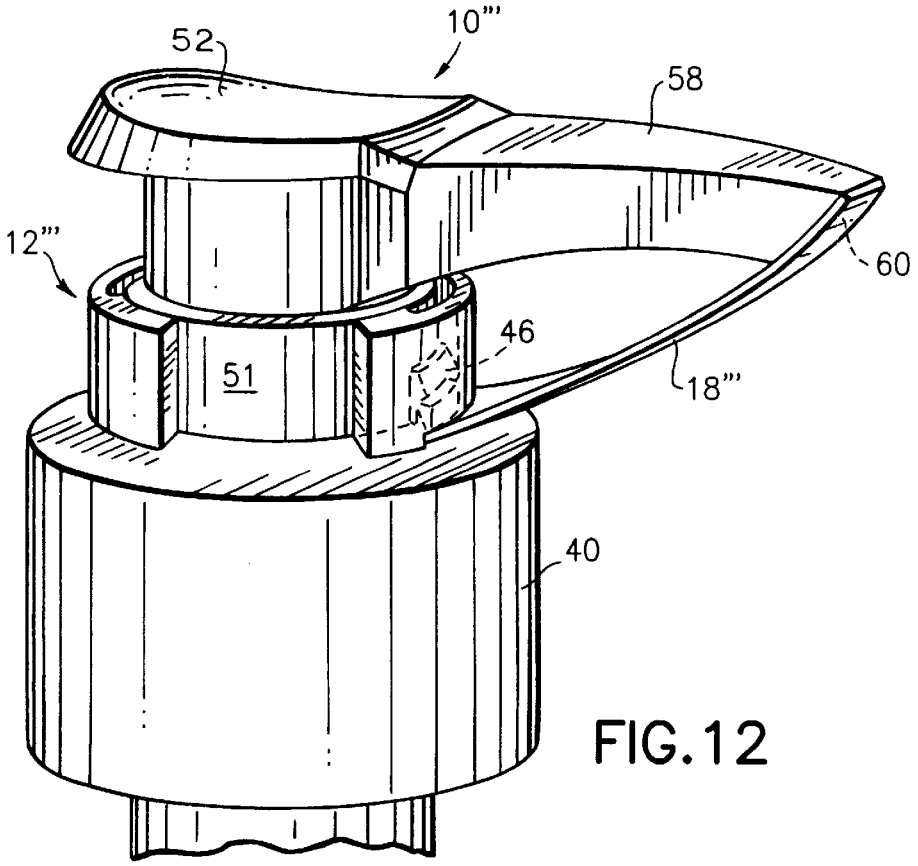
FIG. 12 is a perspective view of a still further modified form of attachment embodying the invention.
Figure 13:
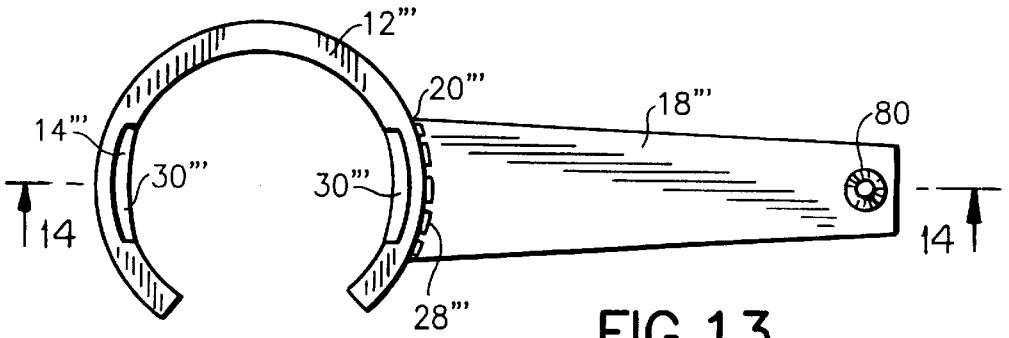
FIG. 13 is a top plan view of the attachment of FIG. 12.
Figure 14:
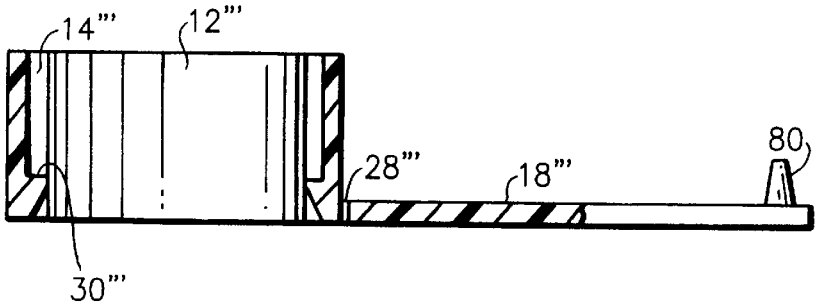
FIG. 14 is a sectional view on the line 14—14 of FIG. 13.

In the third modification, FIGS. 12 through 14, the attachment 10''' is in the form of a support portion 12''' similar to the support portion 12 of FIG. 1 and including the ledges 30''' in the openings 14'''. The support portion 12''' has formed unitary with it a hold-down portion 18''' comprising a strap joined at a juncture 20''' to the support portion 12'''. At the juncture is a frangible zone 28''' of perforations. The distal end of the strap comprising the hold-down portion 18''' is formed with a tapered plug 80.

In assembly, the plug 80 is inserted into the discharge outlet 60 at the end of the spout 58 and the support portion 12''' is snapped over the hooks 46. This will keep the actuator portion and plunger means from rising.

To free the plunger means, the purchaser can tear the strap comprising the hold-down portion at the frangible zone 28''' of perforations and discard the strap. Again, when a shopper sees that the hold-down portion 18''' has been removed, it will be evident that there has been tampering.

The attachment of the invention provides clear evidence of tampering for a pump dispenser. In addition, its various forms are easily assembled on the pump with no modification to the pump or additional parts. Its operation will be readily apparent to the purchaser. While the attachment is intact, the dispenser cannot be operated.

Further variations of the invention are possible. Thus, while the invention has been shown in a limited number of embodiments, it is not so limited but is of a scope defined by the following claim language which may be broadened by an extension of the right to exclude others from making, using or selling the invention as is appropriate under the doctrine of equivalents.

What is claimed is:

1. A fluid dispensing pump having a container cap for mounting the pump on the neck of a container of fluid to be dispensed, the pump comprising a cylinder extending through the cap and rotatably secured thereto, the cylinder having spaced outward hooks at the upper end thereof, reciprocable hollow plunger means projecting into the cylinder and having at its upper end an actuator portion formed with a discharge outlet through which fluid is expelled upon reciprocation of the plunger means, a tamper-evident attachment comprising a cylinder-embracing support portion at least partly encircling the cylinder and having openings therein receiving the hooks respectively, and a plunger means hold-down portion unitary with the cylinder-embracing support portion and extending upward therefrom and engaging the actuator portion and holding the plunger means down, the plunger means hold-down portion having a frangible zone located between the cylinder-embracing support portion and the engagement with the actuator portion.

2. A fluid dispensing pump as claimed in claim 1 wherein the tamper-evident attachment is a unitary molded element and the support portion is a C-shaped clip partly surrounding the upper end of the cylinder and having spaced openings therein partially defined by inward ledges beneath the openings, the ledges engaging the outward hooks.

3. A fluid dispensing pump as claimed in claim 2 wherein the plunger means hold-down portion is an arm extending from a juncture with the C-shaped clip upward along one side of the actuator portion, over the upper end of actuator portion and in engagement therewith.

4. A fluid dispensing pump as claimed in claim 3 wherein the arm terminates in a downward rib extending down an opposite side of the actuator portion.

5. A fluid dispensing pump as claimed in claim 4 wherein the frangible zone is at the juncture and comprises a line of perforations.

6. A fluid dispensing pump as claimed in claim 5 wherein the arm meets the C-shaped clip inward from outer periphery of the. C-shaped clip and the arm is tapered into the C-shaped clip at the juncture.

7. A fluid dispensing pump as claimed in claim 1 wherein the cylinder-embracing support portion comprises a pair of spaced opposed inwardly facing arcuate pads, each having openings therein receiving the respective hooks at the upper end of the cylinder.

8. A fluid dispensing pump as claimed in claim 7 wherein the plunger means hold-down portion comprises an inverted U-shaped arch, having downward legs with lower ends connected respectively to the arcuate pads.

9. A fluid dispensing pump as claimed in claim 8 wherein the frangible zone comprises two lines of perforations at junctures between the arcuate pads and the legs of the arches respectively.

10. A fluid dispensing pump as claimed in claim 2 wherein the actuator portion has a lateral spout containing the discharge outlet and the plunger means hold-down portion is a loop having two lower ends, both unitary with the C-shaped clip at spaced points, the loop arching up over the spout and engaging a top surface thereof.

11. A fluid dispensing pump as claimed in claim 10 wherein the frangible zone is a line of perforations located at a juncture between at least one of the lower ends and the C-shaped clips.

12. A fluid dispensing pump as claimed in claim 10 wherein the frangible zone is two lines of perforations located at respective junctures between the lower ends and the C-shaped clip.

13. A fluid dispensing pump as claimed in claim 1 wherein the actuator portion has a lateral spout containing the discharge outlet and the plunger means hold-down portion is a strap unitary at one end with the cylinder-embracing support portion and having at the other end a plug received into the discharge outlet to comprise the engagement with the actuator portion.

14. A fluid dispensing pump as claimed in claim 13 wherein the cylinder-embracing support portion is circular and has openings therein partly defined by ledges beneath the openings, the ledges engaging the outward hooks.

15. A fluid dispensing pump as claimed in claim 13 wherein the frangible zone is at said one end of the strap.

16. A unitary tamper-evident attachment for a pump dispenser defined by a cylinder having outward hooks at the upper end thereof and plunger means in the cylinder, the attachment comprising a cylinder-embracing support portion having openings adapted to receive respectively the hooks to mount the attachment on the upper end of the cylinder and a plunger means hold-down portion adapted to engage the plunger means and hold it down in the cylinder, the attachment being formed with a frangible zone by which at least a part of the attachment may be broken away from the dispenser to free the plunger means.

* * * * *